US011634936B2

(12) United States Patent
Hardison et al.

(10) Patent No.: US 11,634,936 B2
(45) Date of Patent: Apr. 25, 2023

(54) SWITCH ARRANGEMENTS FOR POWERED DOORS

(71) Applicant: RITE-HITE HOLDING CORPORATION, Milwaukee, WI (US)

(72) Inventors: Carl David Hardison, Maquoketa, IA (US); Daniel Vandermillen, Dubuque, IA (US); Ryan Pfaff, Dubuque, IA (US); Steven Campbell, Peosta, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 94 days.

(21) Appl. No.: 17/169,464

(22) Filed: Feb. 7, 2021

(65) Prior Publication Data

US 2021/0246704 A1 Aug. 12, 2021

Related U.S. Application Data

(60) Provisional application No. 62/971,642, filed on Feb. 7, 2020.

(51) Int. Cl.

| | |
|---|---|
| ***E05F 15/00*** | (2015.01) |
| ***E05F 15/40*** | (2015.01) |
| *E05F 15/57* | (2015.01) |

(52) U.S. Cl.

CPC ..... *E05F 15/40* (2015.01); *E05F 15/57* (2015.01); *E05Y 2201/454* (2013.01);
(Continued)

(58) Field of Classification Search

CPC ..... E05F 15/40; E05F 2015/434; E05F 15/57; E05F 15/59; E05Y 2201/454;
(Continued)

(56) References Cited

U.S. PATENT DOCUMENTS

| | | | |
|---|---|---|---|
| 3,803,943 | A | 4/1974 | Woloszyk |
| 4,651,940 | A | 3/1987 | Nakamura |

(Continued)

FOREIGN PATENT DOCUMENTS

| | | |
|---|---|---|
| CN | 1580479 A | 2/2005 |
| CN | 101438024 | 5/2009 |

(Continued)

OTHER PUBLICATIONS

International Searching Authority, "Written Opinion of the International Searching Authority", issued in connection with PCT Application No. PCT/US2021/016998, dated Jun. 7, 2021, 6 pages.

(Continued)

*Primary Examiner* — Chi Q Nguyen

(74) *Attorney, Agent, or Firm* — Hanley, Flight & Zimmerman, LLC

(57) ABSTRACT

Switch arrangements for powered doors are disclosed. A door includes a panel and a track to guide movement of the panel between an open position and a closed position. The track defines a track slot extending along an exterior length of the track. The door further includes a sensor target to be carried by the panel within the track. The door also includes a sensor selectively attachable to an exterior of the track via the track slot. The sensor to detect the sensor target when the panel is in a first position. The track defines an aperture to be positioned between the sensor target and the sensor when the panel is in the first position.

21 Claims, 10 Drawing Sheets

(52) U.S. Cl.
CPC ..... *E05Y 2201/64* (2013.01); *E05Y 2201/684* (2013.01); *E05Y 2400/44* (2013.01); *E05Y 2600/46* (2013.01); *E05Y 2900/11* (2013.01)

(58) Field of Classification Search
CPC ..... E05Y 2201/64; E05Y 2201/684; E05Y 2201/692; E05Y 2400/44; E05Y 2400/33; E05Y 2400/55; E05Y 2600/46; E05Y 2900/00; E05Y 2900/11
USPC ..... 49/13, 31, 27, 28; 318/264, 265, 266
See application file for complete search history.

(56) References Cited

U.S. PATENT DOCUMENTS

| | | | | |
|---|---|---|---|---|
| 5,353,859 | A | 10/1994 | Oltahfer et al. | |
| 5,450,888 | A | 9/1995 | Schwartzman et al. | |
| 5,533,561 | A | 7/1996 | Forehand, IV | |
| 5,839,227 | A | 11/1998 | Gardner | |
| 6,082,433 | A | 7/2000 | Vafaie et al. | |
| 6,145,571 | A | 11/2000 | Snyder | |
| 6,225,768 | B1 | 5/2001 | Cookson et al. | |
| 6,234,291 | B1 | 5/2001 | Koenders | |
| 6,325,195 | B1 | 12/2001 | Doherty | |
| 6,326,751 | B1 * | 12/2001 | Mullet | E05F 15/41 318/434 |
| 6,422,965 | B1 * | 7/2002 | Balli | E06B 9/74 160/310 |
| 6,598,648 | B1 | 7/2003 | Schulte | |
| 6,837,296 | B2 | 1/2005 | Kimener | |
| 7,355,363 | B2 | 4/2008 | Angiuli et al. | |
| 7,389,807 | B2 | 6/2008 | Nagare et al. | |
| 8,746,321 | B2 | 6/2014 | Miller | |
| 9,309,717 | B2 * | 4/2016 | Hardison, III | E06B 9/86 |
| 9,631,427 | B2 | 4/2017 | Vandermillen et al. | |
| 9,830,825 | B2 * | 11/2017 | Anstett | G08G 1/04 |
| 10,358,858 | B2 * | 7/2019 | Lietz | E06B 9/68 |
| 10,717,614 | B1 * | 7/2020 | Hirschi | G09F 17/00 |
| 11,346,141 | B2 * | 5/2022 | Gregoriou | E06B 9/68 |
| 2005/0057890 | A1 | 3/2005 | Sidlinger et al. | |
| 2005/0253710 | A1 * | 11/2005 | Eskildsen | G08B 13/08 340/545.8 |
| 2006/0113935 | A1 | 6/2006 | Angiuli et al. | |
| 2006/0118253 | A1 | 6/2006 | Slusarski et al. | |
| 2006/0144530 | A1 | 7/2006 | Nagare et al. | |
| 2009/0127375 | A1 | 5/2009 | Heimrich et al. | |
| 2010/0127882 | A1 | 5/2010 | Sitarski | |
| 2010/0287841 | A1 | 11/2010 | Ono et al. | |
| 2011/0032073 | A1 * | 2/2011 | Mullet | G07C 9/00182 340/5.7 |
| 2011/0108214 | A1 | 5/2011 | Komatsu et al. | |
| 2011/0259060 | A1 | 10/2011 | Leska et al. | |
| 2012/0092125 | A1 * | 4/2012 | Farber | E05F 15/668 340/5.7 |
| 2012/0261081 | A1 | 10/2012 | Curtis et al. | |
| 2013/0112354 | A1 | 5/2013 | Hardison, III et al. | |
| 2013/0112358 | A1 | 5/2013 | Hardison, III et al. | |
| 2014/0345812 | A1 | 11/2014 | Casey et al. | |
| 2016/0369557 | A1 | 12/2016 | Vandermillen et al. | |
| 2020/0327754 | A1 * | 10/2020 | Morris | G07C 9/00309 |
| 2021/0123283 | A1 * | 4/2021 | Sutterer | A01K 1/08 |
| 2021/0310294 | A1 * | 10/2021 | Lindley | E05F 15/686 |

FOREIGN PATENT DOCUMENTS

| | | |
|---|---|---|
| DE | 10001201 | 7/2001 |
| DE | 102006015507 | 10/2007 |
| DE | 202011005094 | 7/2012 |
| EP | 0316691 | 5/1989 |
| EP | 1509665 | 3/2005 |
| FR | 2661210 | 10/1991 |
| FR | 2841292 | 12/2003 |
| GB | 1596237 | 8/1981 |
| JP | H03140589 | 6/1991 |
| JP | 139576 | 4/1992 |
| JP | 06-009586 | 2/1994 |
| JP | H11131944 | 5/1999 |
| JP | 2002038855 | 2/2002 |
| JP | 2006307493 | 11/2006 |
| JP | 2007146590 | 6/2007 |
| JP | 2008132347 | 6/2008 |
| JP | 2010112111 | 5/2010 |
| WO | 9406995 | 3/1994 |
| WO | 03097977 | 11/2003 |
| WO | 2011006874 | 1/2011 |
| WO | 2013067312 | 5/2013 |
| WO | 2013067549 | 5/2013 |

OTHER PUBLICATIONS

International Searching Authority, "International Search Report", issued in connection with PCT Application No. PCT/US2021/016998, dated Jun. 7, 2021, 4 pages.

ASSA Abloy Entrance Systems, "Machine Protection Door ASSA Abloy RP 300/ RP300 WIDE/RP300 USD", 10 pages.

Rite-Hite Corporation, "Vertiguard™ Automated Safety Barrier", Jan. 2015, 16 pages.

European Patent Office, "Communication Pursuant to Rules 161(1) and 162 EPC," issued in connection with EP Application No. 21709554.6, dated Sep. 16, 2022, 3 pages.

International Searching Authority, "International Preliminary Report on Patentability," issued in connection with PCT Application No. PCT/US2021/016998, dated Aug. 18, 2022, 8 pages.

* cited by examiner

SWITCH ARRANGEMENTS FOR POWERED DOORS

RELATED APPLICATIONS

This patent claims priority to U.S. Provisional Application No. 62/971,642, which was filed on Feb. 7, 2020, and which is incorporated herein by reference in its entirety.

FIELD OF THE DISCLOSURE

This disclosure generally pertains to powered doors and more specifically to switch arrangements for powered doors.

BACKGROUND

At some facilities, various types of barriers are used to protect workers and other nearby personnel from the risk of injury caused by moving or otherwise hazardous machinery and materials. A few examples of such hazards include large or fast moving parts traveling along a conveyor, computer numerical control (CNC) machining centers throwing chips or coolant, welders emitting eye-damaging light, sprayers, shears, presses, punches, and brakes. Alternatively or in addition, such barriers are used to protect a work product in a work or machine space from contamination or interference from personnel, equipment, and/or environmental factors in the facility.

If periodic access to such work spaces is needed, the barrier may include a power-operated door. Some doors have a generally rigid or pliable panel that opens and closes by translating vertically or horizontally. Other doors have a pliable panel that extends from a rolled-up configuration to close and retracts to open. In some examples, the state or position of a door actuator or signals sent by a controller to the actuator can be used to infer the position of the door at any point in time. However, this inference can be incorrect in the event of fault, failure, or damage experienced by one or more components of the door. This presents a potentially costly and dangerous condition if the inferred door position is relied upon for coordinated activation or movement of equipment or personnel in the work space. Accordingly, in many examples, sensors are used to determine or verify the position of the door. In some cases, operation of the door is interlocked via one or more position-verifying sensors with the operating status of a machine or system to prevent the door from opening when it is unsafe or imprudent to do so.

DETAILED DESCRIPTION

Example doors include door position switch arrangements that are particularly suitable for slender door tracks. Some of the example door position switch arrangements have a non-contact switch that includes a sensor mounted externally on the track and a sensor target attached to a moving part of the door, inside the track. An aperture in the track enables the external sensor to detect the internal sensor target. In some examples, an electromagnetically permeable shield lies between the sensor and the sensor target and covers the aperture.

Figure 1:
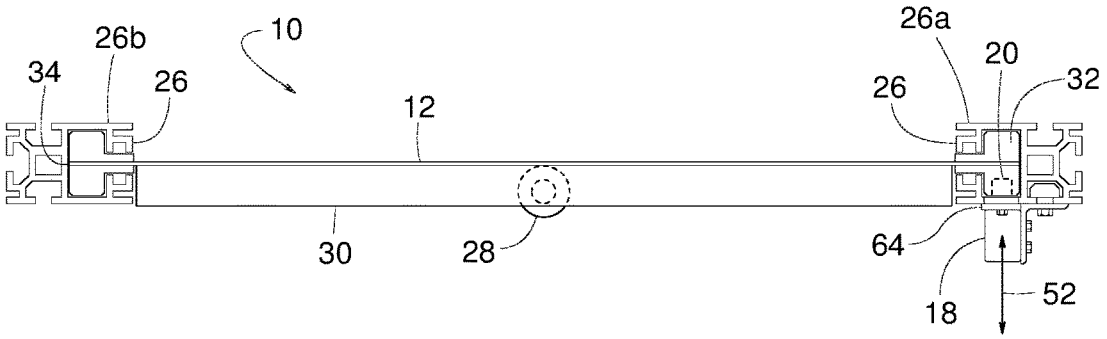
FIG. 1 is a top view of an example door constructed in accordance with teachings disclosed herein.
Figure 2:
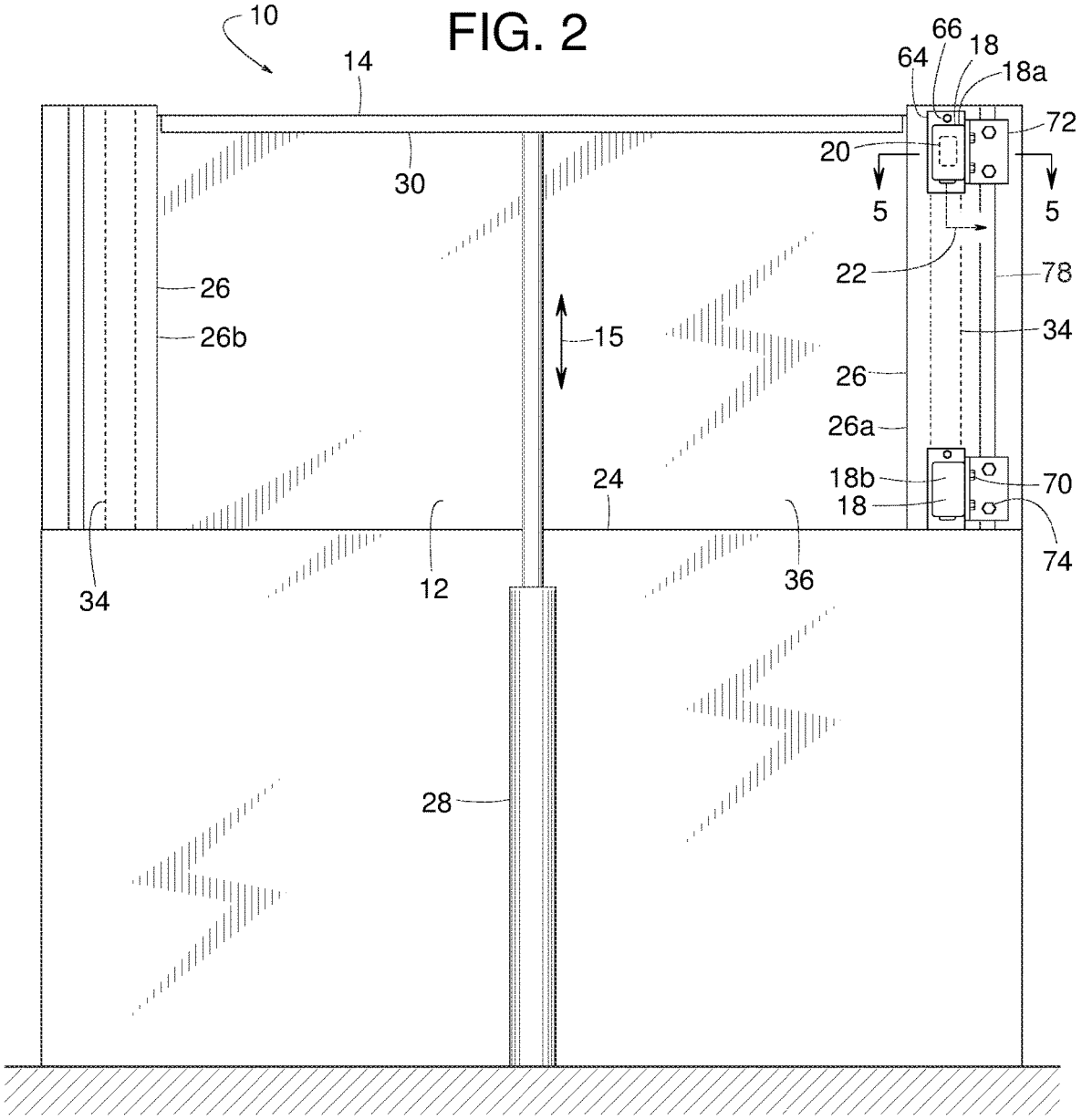
FIG. 2 is a front view of the example door of FIG. 1 with the example door shown in a closed position.
Figure 3:
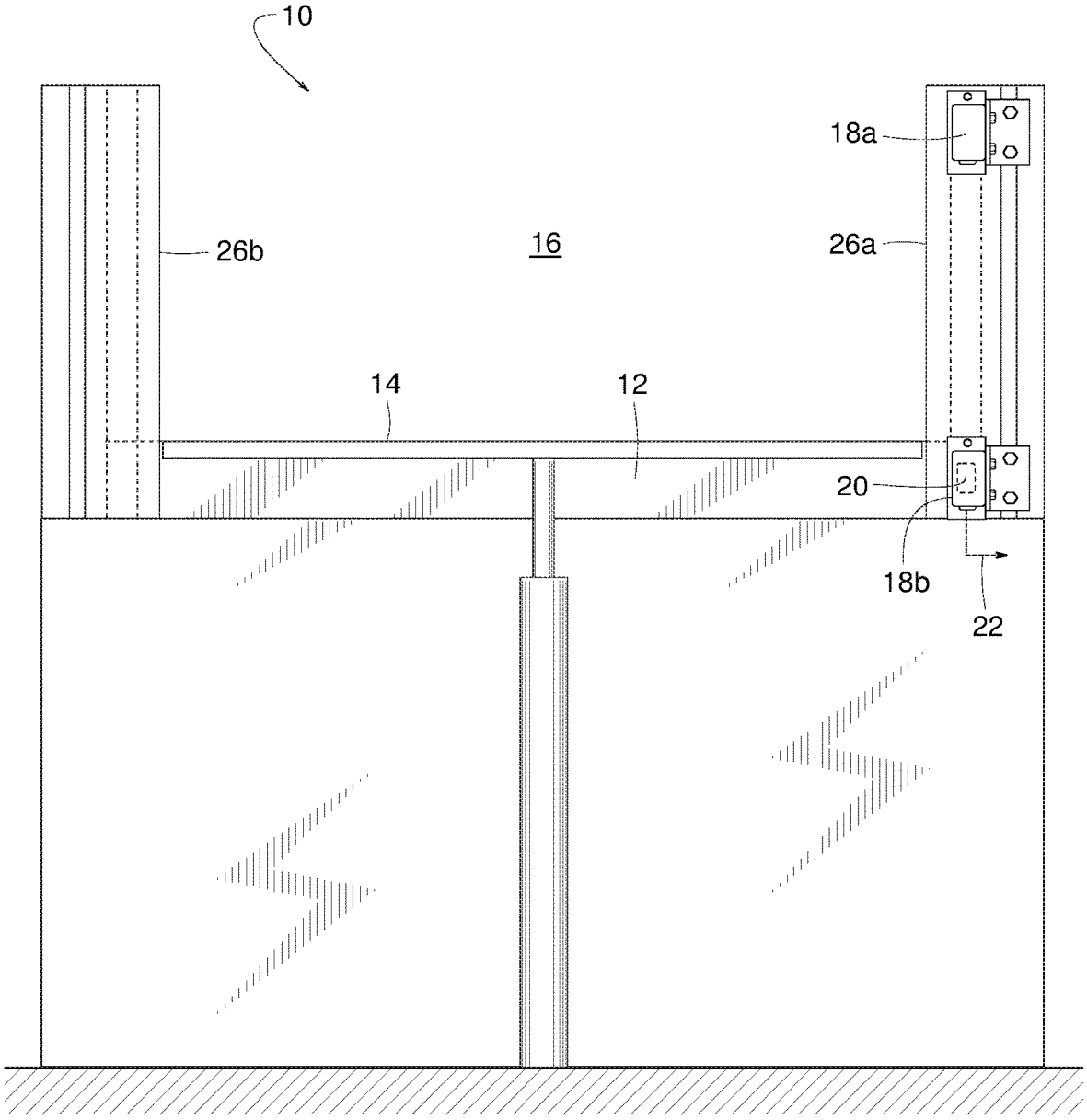
FIG. 3 is a front view of the example door of FIG. 1 similar to FIG. 2 but showing the example door in an open position.
Figure 4:
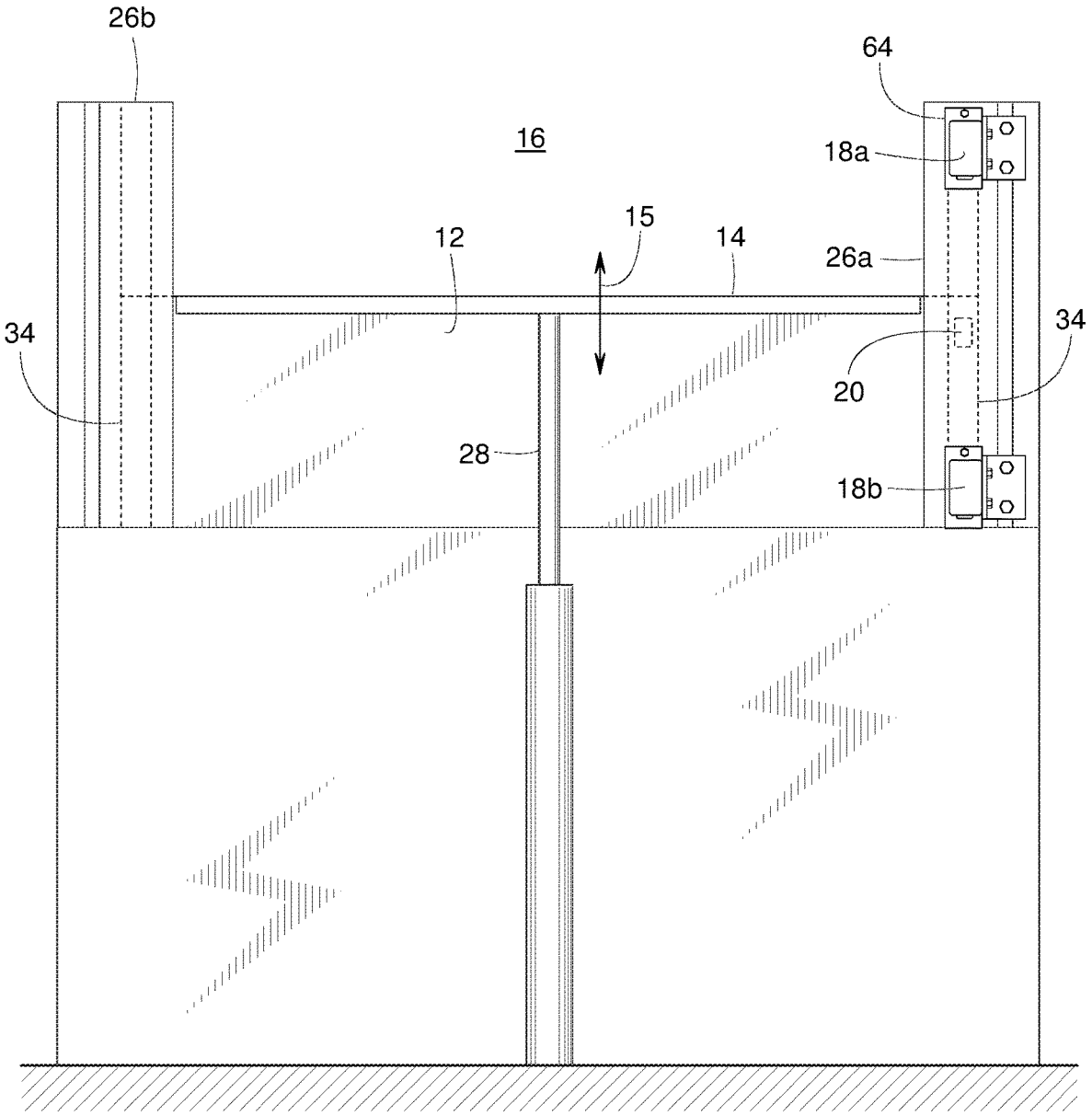
FIG. 4 is a front view of the example door of FIG. 1 similar to FIGS. 2 and 3 but showing the example door partway between closed and open positions.

FIGS. 1-11 show an example door 10 with an example panel 12 having a leading edge 14 that moves (e.g., translates) in a travel direction 15 (e.g., vertically, horizontally, or inclined) to selectively block and unblock an access opening 16. FIG. 2 shows the example panel 12 in a closed position blocking the access opening 16, FIG. 3 shows the example panel 12 in an open position unblocking the access opening 16, and FIG. 4 shows the example panel 12 partway between its open and closed positions. In the illustrated example, at least one sensor 18 (e.g., sensor 18*a* and sensor 18*b*) and a sensor target 20 are used to determine when the door 10 is fully closed (FIG. 2), when the door 10 is fully open (FIG. 3), and/or when the door 10 is at some other predetermined position (e.g., FIG. 4).

As used herein, the term "sensor target" refers to any structural feature or element that can be detected by a sensor associated with it. As used herein, the term "sensor" refers to an electronic device that can provide a signal (e.g., signal 22) in response to detecting a certain target (e.g., sensor target 20).

In the illustrated example, the door 10 includes a generally stationary bottom panel 24, and a track 26 (e.g., a first track 26*a* and a second track 26*b*) oriented to extend along the travel direction 15 of the panel 12. In this example, the track 26 extends to the floor with the bottom panel 24 attached to a front face of the track. The access opening 16 is defined as the space between the tracks 26*a*, 26*b*. In some examples, the track 26 is made from extruded metal (e.g., aluminum), extruded polymer, machined/rolled steel, and/or any other suitable material. However, the track 26 may be made from any other suitable material using any other suitable manufacturing process. The tracks 26 guide the translation of the door panel 12 as an actuator 28 moves the panel 12 between its open and closed positions. In the illustrated example, the actuator 28 is represented as a hydraulic cylinder that extends and retracts to move the panel 12. In other examples, the actuator 28 may be implemented using any other suitable mechanism. For instance, some other examples of the actuator 28 include a pneumatic cylinder, a spool or drum, an electric motor, a leadscrew, a cogged belt and sheaves, a spring, a counterweight, and various combinations thereof, etc.

In some examples, the main part (e.g., bulk) of the panel 12 is made of sheet metal (e.g., 16 gage) with a reinforcement member 30 along the leading edge 14. Other examples of the panel 12 include a thicker or thinner piece of sheet metal, a non-metallic sheet or panel, a panel assembly (e.g., made of multiple sheets of materials and/or other components), a pliable sheet of material, a fabric curtain, and an accordion-like foldable sheet.

Some examples of the door 10 include at least one retainer 32 attached to and extending along each lateral edge 34 of the panel 12. In some examples, the retainers 32 can serve any one or more of multiple purposes, including: retaining the lateral edges 34 of the panel 12 within the tracks 26, enabling the tracks 26 to guide the travel of the panel 12 as the door 10 opens and closes, reinforcing the lateral edges 34 of the panel 12, providing the panel 12 with a low friction, wear resistant surface to interface with the track 26 as the panel 12 moves, and providing a suitable location and structure for mounting the sensor target 20.

In some examples, the retainer 32 is made of plastic. More particularly, in some examples, the retainer 32 is made of UHMW (i.e., ultra high molecular weight polyethylene). Some examples of the retainer 32 include rollers to reduce friction between the retainer 32 and the track 26. In some examples, the retainer 32 extends continuously along substantially (e.g., at least 90% of) the full length of the lateral edge 34 of the panel 12. In other examples, the retainer 32 is one of multiple shorter, spaced-apart segments attached to the panel 12 at certain locations, such as, for example, at or near the leading edge 14 of the panel 12, at or near a trailing edge 36 of the panel 12 (e.g., near a location adjacent the upper edge of the bottom panel 24 when the panel 12 is in the closed position), and/or at various intermediate locations between the leading edge 14 and the trailing edge 36.

Figure 5:
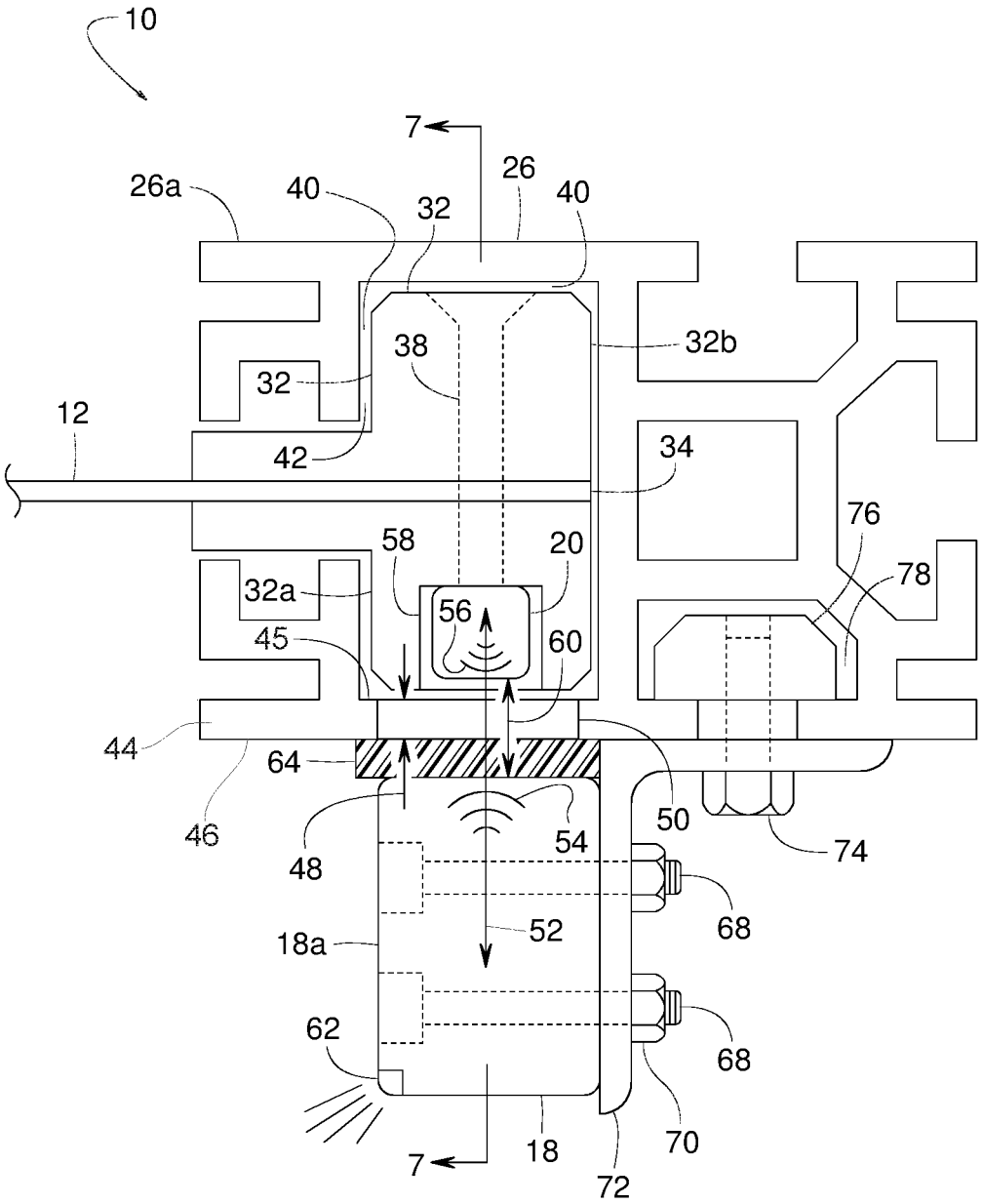
FIG. 5 is a cross-sectional view taken along line 5-5 of FIG. 2.

In the example shown in FIG. 5, the retainer 32 includes a front half 32*a* and a back half 32*b*. In some examples, a fastener 38 (e.g., a screw, a rivet, etc.) connects the halves 32*a*, 36*b* together with the panel 12 sandwiched therebetween. The retainer 32 is designed with sufficient clearance 40 to slide smoothly along a channel or internal passageway 42 defined by walls of the track 26. In some examples, a wall 44 of the track 26 has a wall thickness 48 of about 0.125 inches and defines an aperture 50 extending therethrough. The aperture 50 provides an opening in the wall 44 through which the sensor 18 may interact with and/or otherwise detect the sensor target 20 carried on the retainer 32 attached to the panel 12. That is, as shown in the illustrated example, the sensor 18 and the sensor target 20 are positioned on opposite sides of the wall 44. More particularly, in some examples, the sensor target 20 is positioned to be spaced apart from an inner surface 45 of the exterior wall 44 of the track 26 with the sensor 18 positioned spaced apart from an outer surface 46 of the exterior wall 44 of the track 26. In some examples, the sensor 18 may be positioned to be flush with the outer surface 46 of the wall 44 without extending into the aperture 50 in the wall 44. In some examples, the interaction between the sensor 18 and the sensor target 20 does not require direct physical contact but may be based on the sensor 18 and the sensor target 20 being in proximity with one another. For instance, in some examples, the sensor 18 detects the sensor target 20 based on radio frequency signals passed between the sensor 18 and sensor target 20. In some such examples, the wall 44, which may be made of metal, includes the aperture 50 so that the wall 44 does not block or otherwise interfere with the transmission of signals when the sensor 18 and the sensor target 20 are aligned with the aperture 50 positioned therebetween. In some examples, the radio frequency signal transmissions between the sensor 18 and the sensor target 20 are directional and oriented to pass in a first direction 52 that is generally perpendicular to the wall 44 interposed between the sensor 18 and the sensor target 20.

In some examples, the sensor target 20 is a passive RFID (radio frequency identification) device, sometimes known as a passive RFID actuator, transponder, or tag and the sensor 18 is an RFID reader. In some such examples, when the sensor target 20 is within a predetermined distance (e.g., communication range) of the sensor 18, interrogating radio waves 54 emitted from the sensor 18 pass through the aperture 50 to electromagnetically energize the sensor target 20. The expression, "sensor target 20 being electromagnetically energized by sensor 18" means that electrical voltage or current is induced in the sensor target 20 upon the sensor target 20 being exposed to the radio waves 54 emitted from the sensor 18. When the sensor target 20 is energized by the radio waves 54 of the sensor 18, the sensor target 20 emits return electromagnetic radiation 56 back through the aperture 50 toward the sensor 18. The return electromagnetic radiation 56 from the sensor target 20 is powered by the energy of the emitted radio waves 54 of the sensor 18.

Upon detecting the return electromagnetic radiation 56 from the sensor target 20, in the illustrated example, the sensor 18 generates a signal 22 indicating that the sensor target 20 and the sensor 18 are within a predetermined distance (e.g., communication range) of each other (e.g., based on signal strength). The signal 22 may serve as an indication that the movable panel 12 is at a position with respect to where the sensor 18 is secured along the track 26, and thus indicates a door status (e.g., closed, open, not closed, not open, partially closed, partially open, etc.). In the example shown in FIGS. 2 and 3, the door 10 includes one sensor target 20 (near the leading edge 14 of the panel 12) and two sensors 18*a*, 18*b* spaced apart on the track 26. In the illustrated examples, the sensor target 20 triggers (e.g., is detected by) the first sensor 18*a* when the door 10 is closed because the sensor target 20 substantially aligns with (e.g., is positioned to enable communication with and/or detection of) the first sensor 18*a* when the door 10 is closed. Further, in the illustrated example, the sensor target 20 triggers (e.g., is detected by) the second sensor 18*b* when the door 10 is open because the sensor target 20 substantially aligns with (e.g., is positioned to enable communication with and/or detection of) the second sensor 18*b* when the door 10 is open. In the illustrated example, the sensor target 20 triggers neither the first sensor 18*a* nor the second sensor 18*b* when the door 10 is partially open, as shown in FIG. 4, because the sensor target 20 is spaced apart from (e.g., is outside of communication or detection range of) the sensors 18*a*, 18*b*. Of course, in other examples, either of the first or second sensors 18*a*, 18*b* and/or a third sensor could be positioned at an intermediate point along the track 26 to generate the signal 22 when the panel 12 is at a partially opened positioned corresponding to the location of the intermediate point on the track where the sensor is positioned. In some such examples, the track 26 includes additional apertures 50 at the corresponding intermediate points to enable the sensor 18 to interact with (e.g., detect) the sensor target 20 within the track when at the corresponding location. In some examples, the aperture 50 may be elongate and extend an appreciable length of the track 26 to enable interaction between the sensor 18 and the sensor target 20 at any desired location along the length of the aperture. In some examples, apertures 50 may be included in both the first track 26*a* and the second track 26*b* with corresponding sensors 18 at the different apertures to detect corresponding sensor targets 20 within each track. In some such examples, the sensors 18 on each track 26*a*, 26*b* may be positioned at similar heights to provide redundancy in detecting the position and/or status of the door 10. Additionally or alternatively, the sensors 18 coupled to the different tracks 26*a*, 26*b* may be at different positions along the tracks.

Depending on the particular application of the door 10, the signal 22 generated by the sensor 18 in response to detecting the sensor target 20 can be communicated to a controller and used for any desired purpose (e.g., prevent a machine behind the door 10 from operating, energizing the machine, activating a warning light or alarm, etc.). That is, in some examples, the sensor 18 and sensor target 20 may operate as a switch that provides a status indication and/or may initiate, terminate, and/or prevent certain operations associated with the door 10 and/or the equipment and/or areas adjacent the door 10. In some examples, the signal 22 triggers a change in the operation and/or activation of one or more indicator lights 62 associated with the sensor 18 (e.g., carried by a housing of the sensor 18).

In some examples, the combination of the sensor 18 and the sensor target 20 is referred to as an STR1 non-contact safety switch provided by SICK AG of Waldkirch, Germany. One example of the sensor 18 is a type STR1-XADA-MOAC5 with a part number of 1073224. One example of the sensor target 20 is a type STR1-SAM with a part number of 1073222.

A non-contact switch, such as that created by the sensor 18 and the sensor target 20, allows the sensor target 20 to be recessed within a cavity 58 of the retainer 32 adjacent the wall 44. In some examples, the sensor target 20 is fully recessed within the retainer 32. Consequently, in some such examples, the wall 44 is closer to the retainer 32 than to the sensor target 20. This not only protects the sensor target 20 from wear as the retainer 32 slides along the track 26 but also allows the sensor target 20 to be compactly contained within the channel 42 of the track 26. Further, in some examples, the walls of the cavity 58 completely circumscribe the sensor target 20. That is, in some examples, as shown most clearly in FIG. 10, the material of the retainer 32 extends continuously around an entire perimeter of the sensor target 20. In some such examples, the cavity 58 is shaped to generally correspond to a shape of the outer perimeter of the sensor target 20. While the sensor target 20 is completely inside of the track 26, the non-contact feature of the sensor 18 and the sensor target 20 allows the sensor 18 to be installed entirely outside of the track 26. In some examples, this arrangement can enable the cross-sectional profile (e.g., along the first direction 52 FIGS. 1, 5, 6) of the door track size to be reduced. That is, in some examples, the width of the track 26 (measured in a direction extending perpendicular to the plane of the panel 12) may be limited to the combined thickness of the panel 12, the two halves 32*a*, 32*b* of the retainer 32, the walls on either side of the retainer 32, and the clearance 40 between the retainer 32 and the track walls. In some examples, as shown in the illustrated example, the thicknesses of both halves 32*a*, 32*b* of the retainer 32 are substantially the same. In other examples, the two halves 32*a*, 32*b* may have different thicknesses. In some examples, to enable the sensor target 20 to be fully recessed within the retainer 32, the front half 32*a* of the retainer 32 has a thickness 59 (FIG. 6) that is greater than the thickness 61 (FIG. 1) of the sensor target 20. By contrast, in some examples, the back half 32*b* of the retainer 32 may have a thickness that is less than a thickness of the sensor target 20. Further, in some examples, the sensor target 20 may be positioned within a recess that extends entirely through the thickness 59 of the front half 32*a* of the retainer 32, through an opening in the panel 12, and into the back half 32*b* of the retainer 32. In some such examples, each of the two halves 32*a*, 32*b* may individually have a thickness that is less than the sensor target 20. However, in some such examples, the two halves 32*a*, 32*b* of the retainer may have a combined thickness (including the thickness of the panel 12) that is greater than the thickness 61 of the sensor target 20 to ensure that the sensor target 20 remains spaced apart from the track 26.

Conflicting design issues can arise when trying to adapt a non-contact switch arrangement to examples where the door 10 has tracks 26 that are particularly narrow. If a spaced-apart distance 60 between the sensor 18 and the sensor target 20 (as measured along the first direction 52) needs to be relatively small to enable reliable communications between the sensor 18 and the sensor target 20, it can create an interference problem between the sensor 18 and the retainer 32 when the sensor target 20 is recessed within the retainer 32 because the recessed position of the sensor target 20 places the target farther away from the sensor 18 and, therefore, potentially reducing the ability of radio frequency signals to pass between the two components. Conversely, if the sensor target 20 is not recessed, but instead is mounted flush with the edge of the retainer 32 to avoid the interference problem (e.g., to be closer to the sensor 18), then the sensor target 20 is more exposed to friction along the surface of the channel 42 and thus is subject to increased wear and damage as the retainer 32 slides along the track 26. Moreover, with a narrower cross-sectional profile track, there may be insufficient room in the track 26 to contain both the sensor target 20 and any part of the sensor 18. But if the sensor 18 is installed entirely outside of the track 26 (as shown in the illustrated examples), the aperture 50 can enable intrusion of foreign matter into the channel that can compromise the function of the door and it can create a safety issue (e.g., a hazardous pinch point) at the aperture 50 between the sensor 18 and the retainer 32. While enclosing the pinch point with some sort of guard that covers both the aperture 50 and the sensor 18 can reduce the significance of such concerns, such an enclosure may create additional problems. For instance, such an enclosure or guard can (1) inhibit service access to the sensor 18, (2) obstruct the view of the sensor target 20 and the retainer 32 relative to the sensor 18 and thus inhibit positional adjustment of the sensor 18 relative to the track 26, (3) obstruct the view of status indicator lights 62 of the sensor 18, and/or (4) increase the overall cross-sectional profile of the door. Consequently, addressing all of these issues becomes more than a mere matter of optimizing a single dimensional variable.

Implementing a non-contact switch on a relatively narrow track while avoiding the aforementioned problems, some examples of the door 10 include a shield 64 installed between the sensor target 20 and the sensor 18. More particularly, in some examples, the shield 64 is installed on the outside of the track 26 so as to be between the wall 44 of the track 26 and the sensor 18. In other examples, the shield 64 may fit inside and/or extend into the aperture 50 within the wall 44 of the track 26. As shown in the illustrated example, the shield 64 covers the aperture 50 to physically isolate the channel 42 from the environment outside the track 26 and prevents a pinch point in that area. In some examples, the shield 64 is electromagnetically permeable so as not to adversely impede electromagnetic interaction between the sensor 18 and the sensor target 20. The term, "electromagnetically permeable" means that electromagnetic radiation can readily pass through it. In some examples, the shield 64 is see-through, which can be useful when trying to adjust the alignment of the sensor 18 and the sensor target 20. As used herein, the term "see-through" means that visible light can pass through it. Examples of "see-through" include shields that are transparent, translucent, tinted, include a mesh screen, etc. Some examples of the shield 64 are opaque yet still electromagnetically permeable.

Figure 6:
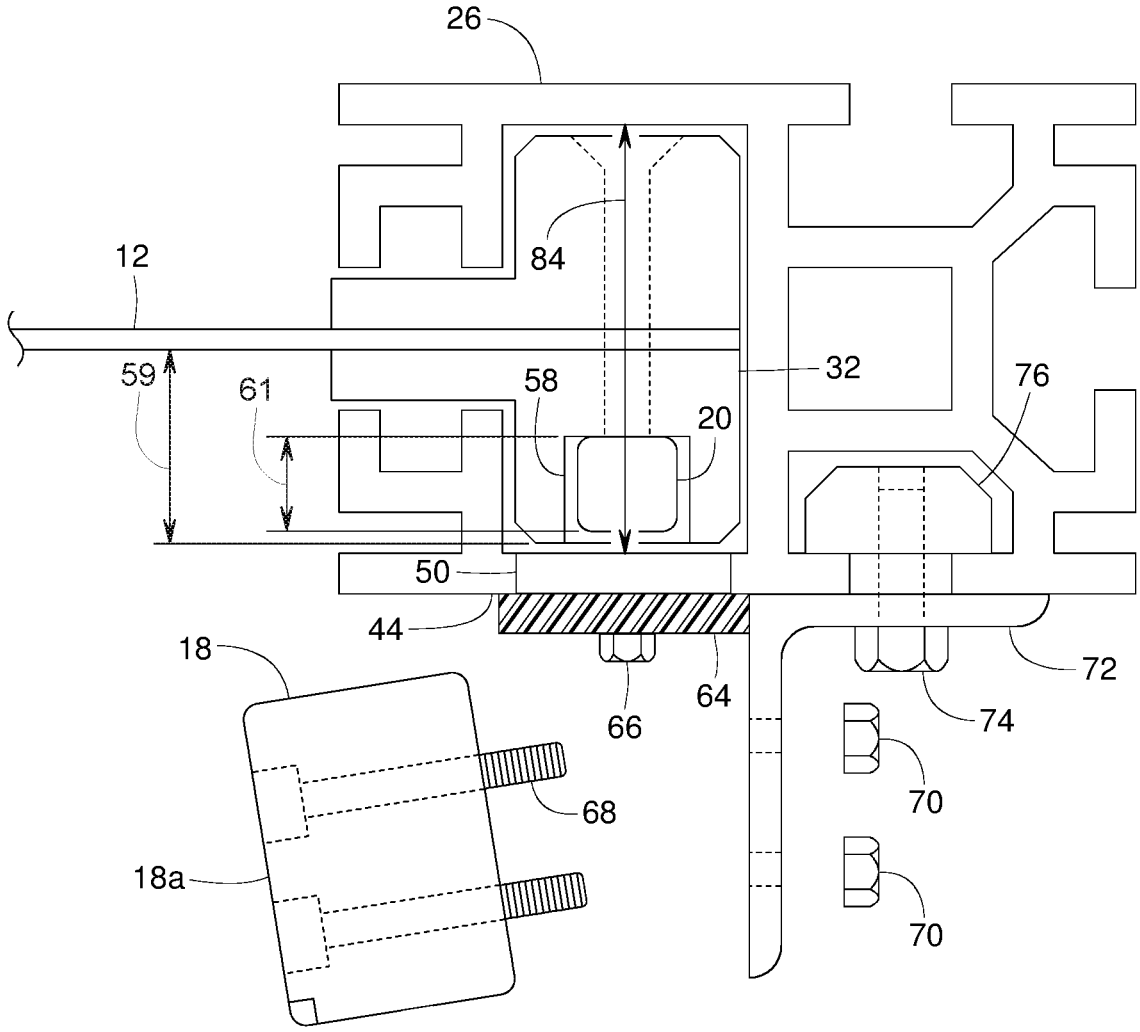
FIG. 6 is a cross-sectional view similar to FIG. 5 but showing an example sensor being removed.

In the example shown in FIGS. 6-10, the shield 64 is a separate piece from the sensor 18, so the sensor 18 can be removed or adjusted without disturbing the shield 64. FIG. 6, for example, shows that the sensor 18 is removable from the track 26 while the shield 64 remains attached to the wall 44 of the track 26. In this example, fasteners 66 connect the shield 64 to the track 26 covering the aperture 50. Additionally or alternatively, the shield 64 may fill the aperture 50 and/or be contained partially or completely within the thickness 48 of the track wall 44 (e.g., by a friction fit, adhesive, etc.).

In the illustrated example, the sensor 18 is connected to the track 26 by way of fasteners 68, nuts 70, bracket 72, fasteners 74, and T-nuts 76. As shown in the illustrated example, the T-nut 76 are selectively positionable along a track slot 78 of the track 26 to allow some adjustment in the positioning of the sensor 18 in a direction parallel to the longitudinal dimension of the track slot 78. More particularly, in some examples, the track slot 78 extends the full length or at least substantially (e.g., at least 90% of) the full length of the track 26, thereby enabling the sensor to be positioned at any desired point along the track. As a result, the sensor 18 can be positioned to align with sensor target 20 carried on the panel 12 when the panel 12 is at a positioned at which detection of the sensor target 20 is desired (e.g., when the panel 12 is fully open, when the panel 12 is fully closed, and/or at an intermediate position corresponding to a partially opened position). That is, in some examples, during set up and/or configuration of the sensor 18, the panel 12 may first be moved to a desired position, and then the sensor 18 mounted to the track 26 at a suitable position (along the track slot 78) to align the sensor 18 with the sensor target 20 when the panel is at the desired position. The see-through nature of the shield 64, as described above may facilitate a person in positioning the sensor 18 in alignment with the sensor target 20 because the person will be able to see the sensor target 20 inside the track 26 through the shield 64 to determine the proper position for the sensor 18 (along the track slot 78) on the exterior of the track 26. At the same time, the shield 64 covers the aperture 50 to cover a potential pinch point for a person during the mounting and/or configuration of the sensor 18. Enabling a person to see the sensor target 20 within the track 26 and selectively adjust the placement of the sensor 18 via the track slot 78 on the outside of the track eliminates the need to include a rigid member to catch, stop, or hold the sensor target 20 in a fixed position relative to the sensor 18 independent of the panel 12 and the retainer 32 that moves therewith. That is, in some examples, the track slot enables the alignment of the sensor 18 to the sensor target 20 when the panel 12 is at any desired position without a rigid member (separate from the panel 12) securing the position of the sensor target 20 relative to the sensor 18.

Figure 7:
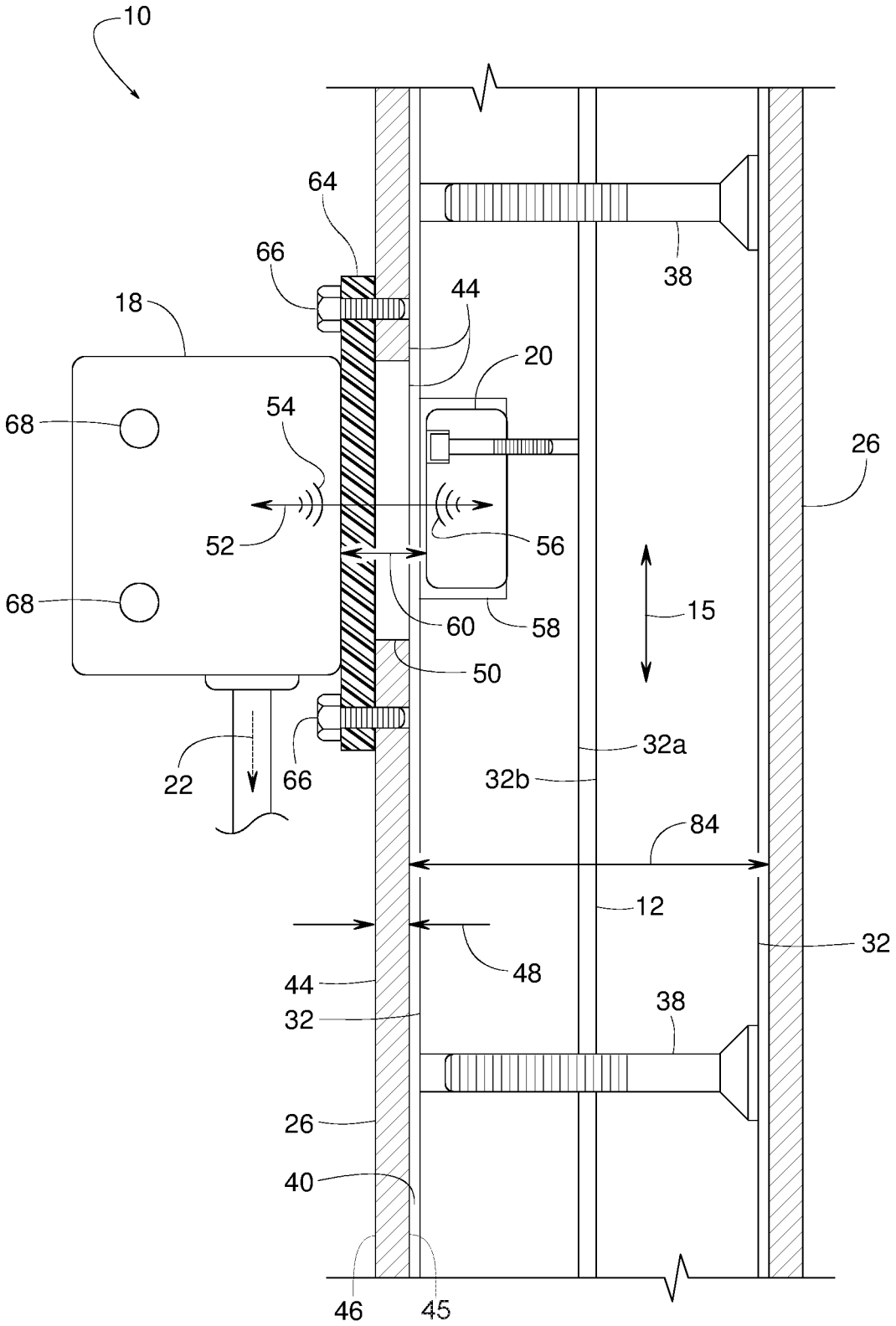
FIG. 7 is a cross-sectional view taken along line 7-7 of FIG. 5.
Figure 8:
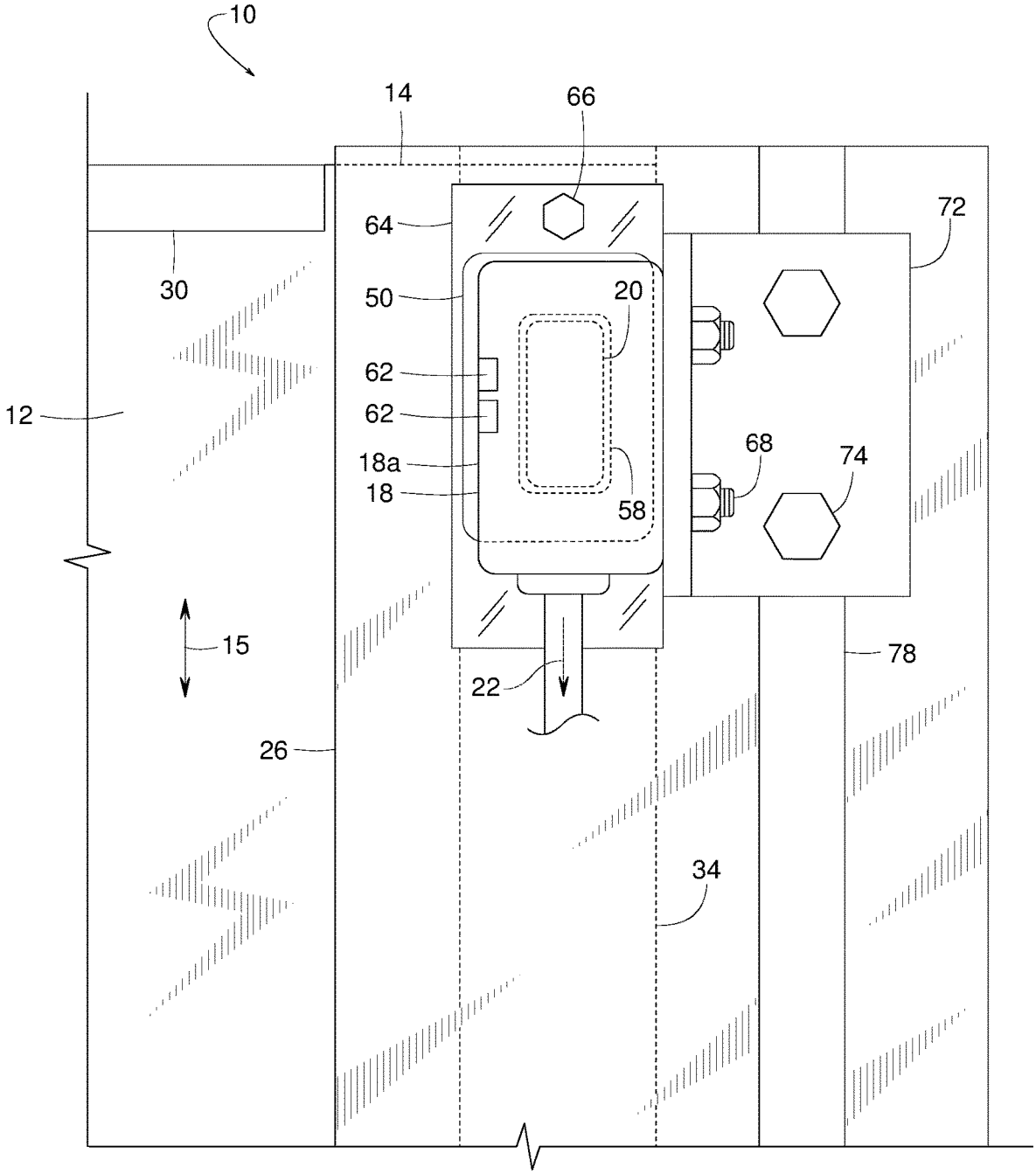
FIG. 8 is an enlarged front view of the upper right corner of FIG. 2.
Figure 9:
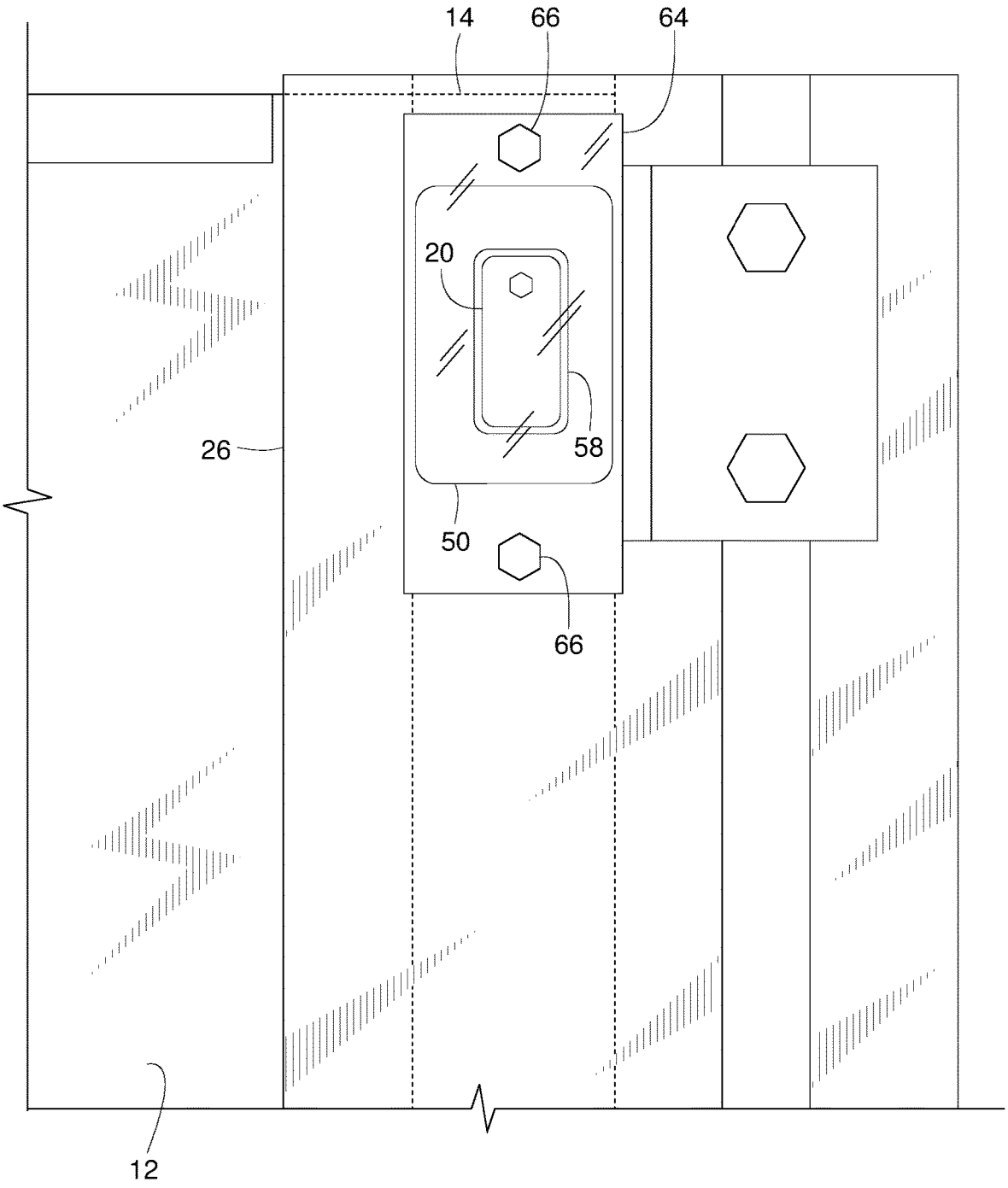
FIG. 9 is a front view similar to FIG. 8 but with the sensor removed.
Figure 10:
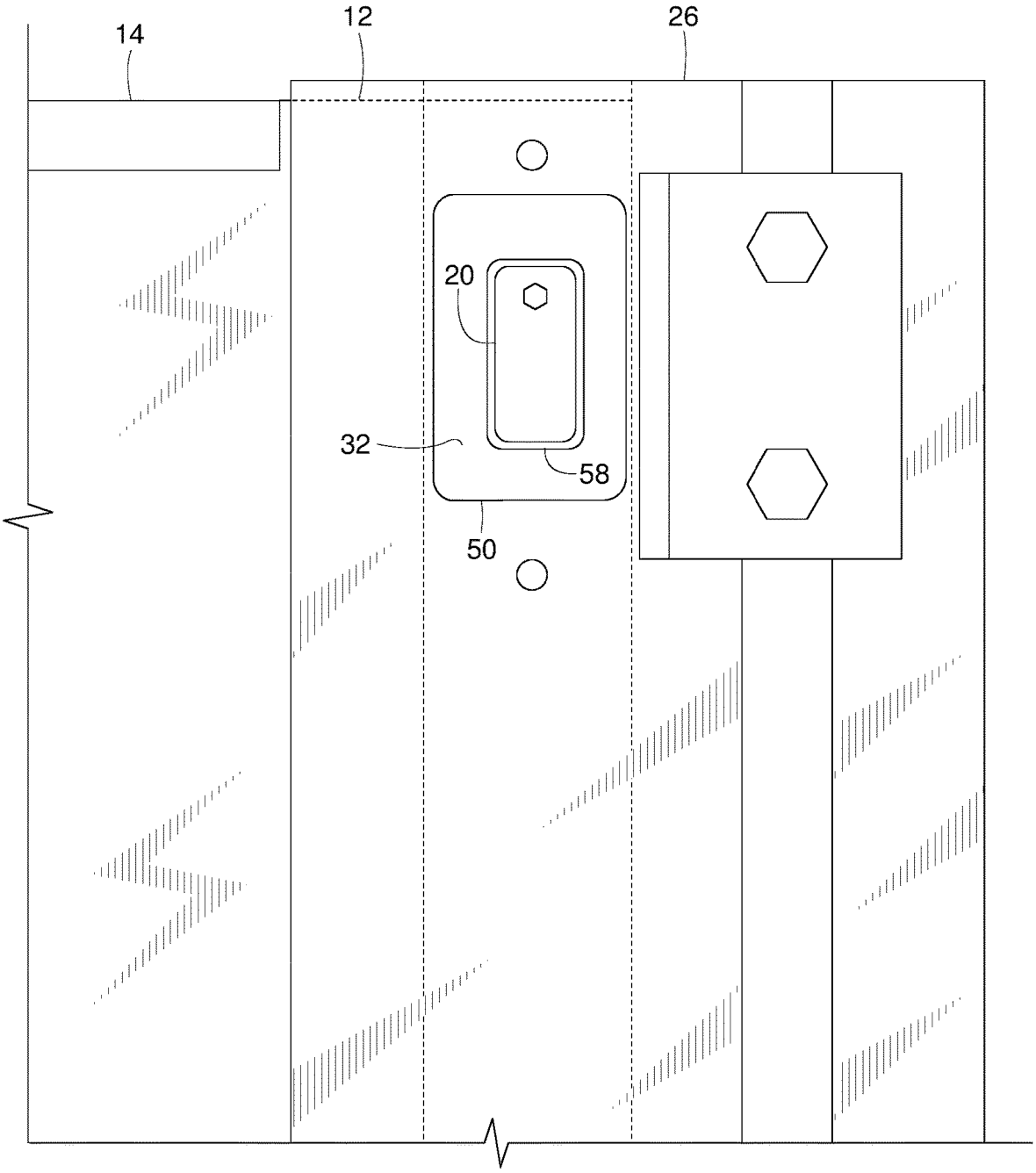
FIG. 10 is a front view similar to FIGS. 8 and 9 but with both the sensor and an example shield removed.
Figure 11:
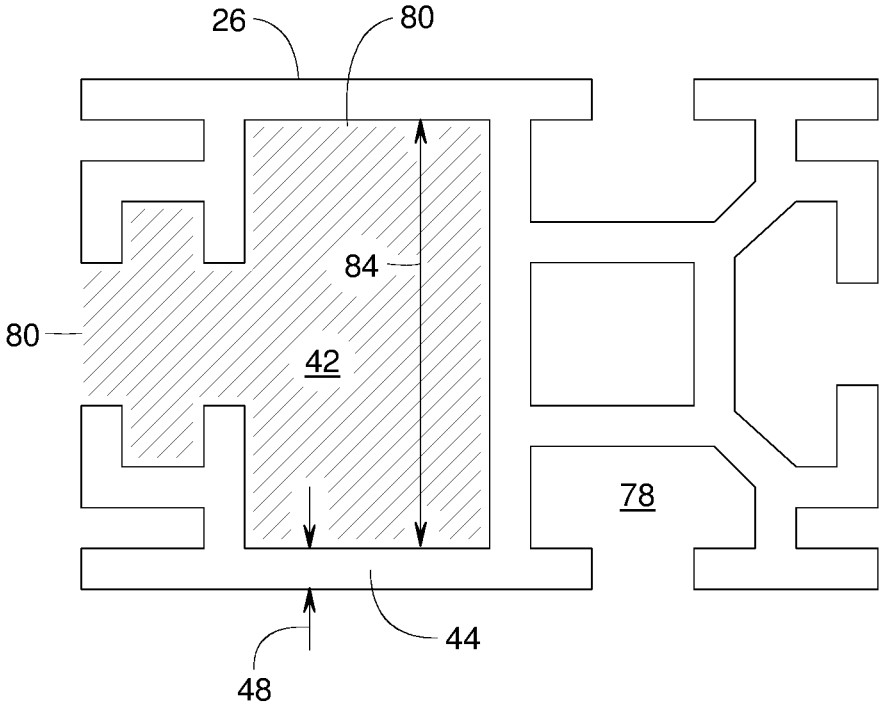
FIG. 11 is a cross-sectional view of an example track constructed in accordance with teachings disclosed herein.

To illustrate how the pieces fit together in this example, FIG. 6 shows the sensor 18 being removed while the shield 64 remains in place, FIGS. 7 and 8 show both the sensor 18 and the shield 64 in attached, operable positions, FIG. 9 shows the sensor 18 removed while the shield 64 is still attached to the track 26, and FIG. 10 shows both the sensor 18 and the shield 64 removed.

The particular design and/or shape of the track 26 may be different than what is shown in the illustrated examples with different sizes and/or shapes of the track 26 resulting in different sizes and/or shapes for an internal cross-sectional area 80 (highlighted by the cross-hatching in FIG. 11) of the channel 42. In some examples, the size, shape, and/or design of the track 26 and the corresponding thickness 48 of the walls 44 are constructed such that the square-root of the internal cross-sectional area 80 ranges from 5 to 15 times the wall thickness 48. For instance, in some examples, the internal cross-sectional area 80 of the channel 42 is about 1.2 square-inches, so the square-root of that is about 1.1 inches indicating the wall thickness 48 may range, in this example, from about 0.073 inches (e.g., 1.1/15) to about 0.219 inches (e.g., 1.1/5). As noted above, in some examples, the wall thickness 48 is about 0.125 inches, which is within the designated range of the above example. Maintaining the relationship between the cross-sectional area 80 and the wall thickness 48 to within the range outlined above reduces the likelihood of track designs that are larger than needed and/or that do not provide adequate structural support (e.g., a flimsy track).

Further, in some examples, the size, shape, and/or design of the track 26 and the corresponding wall thickness 48 are such that the spaced-apart distance 60 (shown in FIG. 5) between the sensor 18 and the sensor target 20 ranges from 1 to 10 times the wall thickness 48. Thus, in some examples, where the wall thickness 48 is 0.125 inches, the spaced-apart distance 60 ranges from 0.125 inches (e.g., 0.125×1) and 1.25 inches (e.g., 0.125×10). In some examples, the spaced-apart distance 60 is about 0.325 inches, which is within the designated range of the above example. Maintaining the relationship between the spaced-apart distance 60 and the wall thickness 48 to within the range outlined above provides a sufficient distance between the sensor 18 and the sensor target 20 such that the sensor 18 does not need to extend into the track 26, while also keeping the sensor 18 and the sensor target 20 sufficiently close to enable reliable communications therebetween. FIG. 5 also shows that with the sensor target 20 being recessed within the cavity 58 of the retainer 32, the track wall 44 is closer to retainer 32 than to the sensor target 20, thus protecting sensor target 20 from wearing against the wall 44.

Further, in some examples, the size, shape, and/or design of the track 26 and the corresponding channel 42 are such that a width 84 of the channel 42 ranges from 1 to 15 times the spaced-apart distance 60 (e.g., the distance between sensor 18 and sensor target 20). As shown in the illustrated example, the width 84 of the channel 42 is measured with reference to first direction 52, which is generally perpendicular to the panel 12. Thus, in some examples, where the spaced-apart distance 60 is 0.325 inches, the width 84 of the channel 42 ranges from 0.325 inches (e.g., 0.325×1) and 4.875 inches (e.g., 0.325×15). In some examples, the width 84 is 1.25 inches, which is within the designated range of the above example. Maintaining the relationship between the width 84 and the spaced-apart distance 60 to within the range outlined above enables the sensor 18 to be sufficiently close to the sensor target 20 for reliable communications therebetween without having to position the sensor 18 to extend into the channel 42, which can create some of the problems mentioned earlier.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

Further examples and combinations thereof include the following:

Example 1 includes a door comprising a panel, a track to guide movement of the panel between an open position and a closed position, the track defining a track slot extending along an exterior length of the track, a sensor target to be carried by the panel within the track, and a sensor selectively attachable to an exterior of the track via the track slot, the sensor to detect the sensor target when the panel is in a first position, the track defining an aperture to be positioned between the sensor target and the sensor when the panel is in the first position.

Example 2 includes the door of example 1, further including a retainer to be attached to a lateral edge of panel, the retainer to interface with the track as the panel moves between the open position and the closed position, the sensor target to be positioned within a cavity within the retainer.

Example 3 includes the door of example 2, wherein the retainer is closer to an inner surface of a wall of the track than the sensor target.

Example 4 includes the door of example 2, wherein the retainer is to extend substantially a full length of the panel.

Example 5 includes the door of example 2, wherein the retainer is to circumscribe a perimeter of the sensor target.

Example 6 includes the door of example 2, wherein walls of the cavity define a shape corresponding to a shape of the sensor target.

Example 7 includes the door of example 1, wherein the sensor target is to be positioned spaced apart from an inner surface of a wall of the track and the sensor is to be spaced apart from an outer surface of the wall of the track.

Example 8 includes the door of example 1, wherein neither the sensor target nor the sensor extend into the aperture.

Example 9 includes the door of example 1, wherein the track slot enables alignment of the sensor to the sensor target when the panel is in the first position without a rigid member, separate from the panel, securing the position of the sensor target relative to the sensor.

Example 10 includes the door of example 1, further including a shield to be positioned between the sensor and the sensor target and to cover the aperture.

Example 11 includes the door of example 10, wherein the shield is mounted to an outer surface of a wall of the track.

Example 12 includes the door of example 10, wherein the shield is see-through to enable a person to see the sensor target within the track.

Example 13 includes the door of example 10, wherein the shield is mountable to the track independent of the sensor.

Example 14 includes the door of example 10, wherein the shield is electromagnetically permeable to enable radio frequency communications between the sensor and the sensor target.

Example 15 includes the door of example 1, wherein the sensor target is a passive RFID tag to be energized by the sensor.

Example 16 includes the door of example 1, wherein the first position corresponds to one of the open position or the closed position.

Example 17 includes the door of example 1, wherein the sensor is a first sensor, the door further including a second sensor to be attached to the track via the track slot at a different position than the first sensor.

Example 18 includes a door comprising a panel, a track to guide movement of the panel between an open position and a closed position, a sensor target to be carried by the panel within the track, a wall of the track including an aperture, the sensor target to be visible through the aperture when the panel is in a first position, and a sensor selectively attachable to an exterior of the track via the track slot, a position of the sensor relative to the track to be adjustable, the sensor to detect the sensor target when the panel is in the first position.

Example 19 includes the door of example 18, further including a see-through shield to be mounted to the track to cover the aperture, the sensor being removable from the first track while the shield remains mounted to the track.

Example 20 includes a door comprising a track including an internal channel and an external track slot, a panel, a retainer to be attached to a lateral edge of the panel, the retainer to move within the internal channel of the track to guide movement of the panel between an open position and a closed position, a sensor target to be carried by the retainer, and a sensor selectively attachable to an exterior of the track via the external track slot, the sensor to detect the sensor target when the panel is in a first position.

Example 21 includes a door for selectively blocking and unblocking an access opening, the door comprising a first track defining an internal passageway and an aperture, a second track being spaced apart from the first track to define the access opening therebetween, a panel extending between the first track and the second track, the panel being movable in a travel direction selectively between an open position and a closed position, the panel blocking more of the access opening in the closed position than in the open position, a retainer attached to the panel, the retainer being disposed at least partially within the internal passageway and being movable along the first track as the panel moves between the open position and the closed position, a sensor supported by the first track, a sensor target on the retainer such that the aperture is between the sensor target and the sensor when the panel is in the closed position, the sensor target being electromagnetically energized by the sensor when the panel is in the closed position, and a shield attached to the first track and extending across the aperture, the shield being electromagnetically permeable, the shield being interposed between the sensor target and the sensor when the panel is in the closed position.

Example 22 includes the door of example 18, wherein the shield is see-through.

Example 23 includes the door of example 18, wherein the first track includes a wall that defines the aperture, and the sensor target is recessed within a cavity defined by the retainer such that the wall is closer to the retainer than to the sensor target.

Example 24 includes the door of example 18, wherein the first track includes a wall that defines the aperture, the wall has a wall thickness, the internal passageway has a cross-sectional area perpendicular to the travel direction of the panel, a square-root of the cross-sectional area divided by the wall thickness being between five and fifteen.

Example 25 includes the door 10 of example 18, wherein the first track includes a wall that defines the aperture, the wall has a wall thickness, the sensor and the sensor target are at a spaced-apart distance from each other when the panel is at the closed position, the spaced-apart distance divided by the wall thickness being greater than one and less than ten.

Example 26 includes the door of example 18, wherein the sensor is removable from the first track while the shield remains attached to a wall of the first track.

Example 27 includes a door for selectively blocking and unblocking an access opening, the door comprising a first track including a wall and defining an internal passageway, the wall having a wall thickness and defining an aperture, a second track spaced apart from the first track to define the access opening therebetween, a panel extending between the first track and the second track, the panel being movable in a travel direction selectively between an open position and a closed position, the panel blocking more of the access opening in the closed position than in the open position, a retainer attached to the panel, the retainer being at least partially disposed within the internal passageway and being movable along the first track as the panel moves between the open position and the closed position, a sensor supported by the first track, and a sensor target on the retainer such that the aperture is between the sensor target and the sensor when the panel is in the closed position, the sensor and the sensor target being at a spaced-apart distance from each other when the panel is at the closed position, the spaced-apart distance divided by the wall thickness being greater than one and less than ten.

Example 28 includes the door of example 24, further including a shield attached to the wall and extending across the aperture, the shield being electromagnetically permeable, the shield being interposed between the sensor target and the sensor when the panel is in the closed position.

Example 29 includes the door of example 25, wherein the shield is see-through.

Example 30 includes the door of example 25, wherein the sensor is removable from the first track while the shield remains attached to the wall.

Example 31 includes the door of example 24, wherein the sensor target is an RFID device electromagnetically energized by the sensor when the panel is in the closed position.

Example 32 includes the door of example 24, wherein the sensor target is recessed within a cavity defined by the retainer such that the wall is closer to the retainer than to the sensor target.

Example 33 includes the door of example 24, wherein the internal passageway has a cross-sectional area perpendicular to the travel direction of the panel, a square-root of the cross-sectional area divided by the wall thickness being between five and fifteen.

Example 34 includes the door of example 24, wherein the internal passageway has a width extending perpendicular to the panel, the width divided by the spaced-apart distance being between one and fifteen.

Example 35 includes a door for selectively blocking and unblocking an access opening, the door comprising a first track including a wall and defining an internal passageway, the wall having a wall thickness and defining an aperture, a second track spaced apart from the first track to define the aperture therebetween, a panel extending between the first track and the second track, the panel being movable in a travel direction selectively between an open position and a closed position, the panel blocking more of the access opening in the closed position than in the open position, the internal passageway of the first track having a cross-sectional area perpendicular to the travel direction of the panel, a square-root of the cross-sectional area divided by the wall thickness being between five and fifteen, a retainer attached to the panel, the retainer being at least partially disposed within the internal passageway and being movable along the first track as the panel moves between the open position and the closed position, the retainer defining a cavity, a sensor supported by the first track, a sensor target recessed within the cavity of the retainer such that the wall is closer to the retainer than to the sensor target and further such that the aperture is between the sensor target and the sensor when the panel is in the closed position, the sensor target being electromagnetically energized by the sensor when the panel is in the closed position, the sensor and the sensor target being at a spaced-apart distance from each other when the panel is at the closed position, and a shield attached to the wall and extending across the aperture, the shield being electromagnetically permeable, the shield being interposed between the sensor target and the sensor when the panel is in the closed position, the spaced-apart distance divided by the wall thickness 48 being greater than one and less than ten.

Example 36 includes the door of example 32, wherein the shield is see-through.

Example 37 includes the door of example 32, wherein the sensor is removable from the first track while the shield remains attached to the wall.

Example 38 includes the door of example 32, wherein the internal passageway has a width, the width divided by the spaced-apart distance being between one and fifteen.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A door comprising:

a panel;

a track to guide movement of the panel between an open position and a closed position, the track defining a track slot extending along an exterior length of the track;

a sensor target to be carried by the panel within the track; and a sensor selectively attachable to an exterior of the track via the track slot, the sensor to detect the sensor target at a first point in time, the first point in time corresponding to the panel being in a first position, the track defining an aperture to be positioned between the sensor target and the sensor when the panel is in the first position.

2. The door of claim 1, further including a retainer to be attached to a lateral edge of the panel, the retainer to interface with the track as the panel moves between the open position and the closed position, the sensor target to be positioned within a cavity within the retainer.

3. The door of claim 2, wherein the retainer is closer to an inner surface of a wall of the track than the sensor target.

4. The door of claim 2, wherein the retainer is to extend substantially a full length of the panel.

5. The door of claim 2, wherein the retainer is to circumscribe a perimeter of the sensor target.

6. The door of claim 2, wherein walls of the cavity define a shape corresponding to a shape of the sensor target.

7. The door of claim 1, wherein the sensor target is to be positioned spaced apart from an inner surface of a wall of the track and the sensor is to be spaced apart from an outer surface of the wall of the track.

8. The door of claim 1, wherein neither the sensor target nor the sensor extend into the aperture.

9. The door of claim 1, wherein the track slot enables alignment of the sensor to the sensor target when the panel is in the first position without a rigid member, separate from the panel, securing a position of the sensor target relative to the sensor.

10. The door of claim 1, further including a shield to be positioned between the sensor and the sensor target and to cover the aperture.

11. The door of claim 10, wherein the shield is mounted to an outer surface of a wall of the track.

12. The door of claim 10, wherein the shield is see-through to enable a person to see the sensor target within the track.

13. The door of claim 10, wherein the shield is mountable to the track independent of the sensor.

14. The door of claim 10, wherein the shield is electromagnetically permeable to enable radio frequency communications between the sensor and the sensor target.

15. The door of claim 1, wherein the sensor target is a passive RFID tag to be energized by the sensor.

16. The door of claim 1, wherein the first position corresponds to one of the open position or the closed position.

17. The door of claim 1, wherein the sensor is a first sensor, the door further including a second sensor to be attached to the track via the track slot at a different position than the first sensor.

18. A door comprising:

a panel;

a track to guide movement of the panel between an open position and a closed position;

a sensor target to be carried by the panel within the track, a wall of the track including an aperture, the sensor target to be visible through the aperture at a first point in time, the first point in time corresponding to the panel being in a first position; and a sensor selectively attachable to an exterior of the track via a slot in the track, a position of the sensor relative to the track to be adjustable, the sensor to detect the sensor target when the panel is in the first position.

19. The door of claim 18, further including a see-through shield to be mounted to the track to cover the aperture, the sensor being removable from the track while the shield remains mounted to the track.

20. A door comprising:

a track including an internal channel and an external track slot;

a panel;

a retainer to be attached to a lateral edge of the panel, the retainer to move within the internal channel of the track to guide movement of the panel between an open position and a closed position;

a sensor target to be carried by the retainer; and a sensor selectively attachable to an exterior of the track via the external track slot, the sensor to detect the sensor target at a first point in time, the first point in time corresponding to the panel being in a first position.

21. The door of claim 1, wherein the track includes a channel, the panel to extend into the channel through an opening in the channel, the track slot distinct from the opening and distinct from the channel.

* * * * *